United States Patent [19]

Miller et al.

[11] Patent Number: 4,845,802

[45] Date of Patent: Jul. 11, 1989

[54] CARPET CLEANING APPARATUS

[75] Inventors: Matthew Miller, Leeds, England; Jonathan Miller, Tenafly, N.J.; Michael B. Woodhall, Maidenhead; Mark F. Jennings, Windsor, both of England

[73] Assignee: Shop-Vac Corporation, Williamsport, Pa.

[21] Appl. No.: 149,622

[22] Filed: Jan. 28, 1988

[30] Foreign Application Priority Data

Feb. 10, 1987 [GB] United Kingdom ..... 8702909

[51] Int. Cl.[4] ..... A47L 7/00

[52] U.S. Cl. ..... 15/321; 15/320; 15/322

[58] Field of Search ..... 15/321, 322, 320

[56] References Cited

U.S. PATENT DOCUMENTS

| | | | |
|---|---|---|---|
| 2,999,258 | 9/1961 | Berberian | 15/50 R |
| 3,065,489 | 4/1960 | Wright | 15/353 |
| 3,964,925 | 6/1976 | Burgoon | 15/332 X |
| 4,123,818 | 11/1978 | Hurwitz | 15/321 |
| 4,156,952 | 6/1979 | Lynch | 15/322 X |
| 4,329,756 | 5/1982 | Chicoine et al. | 15/321 |
| 4,558,484 | 12/1985 | Groth | 15/320 |
| 4,712,740 | 12/1987 | Duncan et al. | 15/321 |

FOREIGN PATENT DOCUMENTS 1571770 7/1980 United Kingdom .

*Primary Examiner*—Chris K. Moore

*Attorney, Agent, or Firm*—Ostrolenk, Faber, Gerb & Soffen

[57] ABSTRACT

A carpet cleaning attachment, for use with existing carpet cleaning devices having a flexible attachment hose and a unit capable of extracting both wet and dry materials, the attachment comprising a hollow, elongated, hand-held wand configured at a connection end thereof for connection to the hose and provided at the opposite end with a suction nozzle for being moved across a carpet; a cleaning fluid reservoir mounted on the wand; and a cleaning fluid delivery system carried on the wand for delivering cleaning fluid from the reservoir to a region of the carpet in advance of the moving nozzle.

16 Claims, 4 Drawing Sheets

CARPET CLEANING APPARATUS

BACKGROUND OF THE INVENTION

1. Field of the Invention

This invention relates to carpet cleaning apparatus, and more particularly to a fluid-delivering attachment for a wet-and-dry vacuum cleaner.

2. Description of Related Art

It is recognized that conventional vacuum cleaning devices will fail to remove from the carpet certain categories of dirt which can only satisfactorily be dealt with by the application of water or other cleaning fluid. Carpet cleaning apparatus has previously been provided which will spray or otherwise deliver a cleaning fluid to the region of carpet in advance of the moving suction nozzle. Dirt that would not be removed by suction alone is taken up by the cleaning fluid in solution or suspension and the cleaning fluid is then extracted by the suction nozzle. It is possible in this manner to clean carpet and leave it almost dry.

One form of known cleaning apparatus comprises a suction unit which stands on rollers, casters or the like. The suction unit contains, in addition to the vacuum pump, a receptacle for extracted fluid and dirt; a reservoir for cleaning fluid; and a cleaning fluid pump. A suction hose is connected to the vacuum unit and to a generally conventional wand, which is adapted to be held with the hands, and is formed at the opposite end with a suction nozzle. A cleaning fluid pipe extends from the vacuum unit to the nozzle in such a manner that fluid from the reservoir, pressurized by the pump, is deposited on the carpet immediately in front of the moving nozzle.

A second type of known apparatus differs from the first in that there is no flexible suction hose. The assembly containing the vacuum unit, water and dirt receptacle, pump and water reservoir is provided with an upright handle and is designed to be maneuverable over the carpet. The suction nozzle and water delivery spout are formed integrally with the main assembly.

While the known apparatus is efficient in cleaning carpets, there is a relatively high capital cost, and since domestic users are likely to clean carpets in this manner comparatively infrequently, purchase of the apparatus may not be an economic proposition.

Also, in these known units the reservoir and fluid pump are combined in a single unit with the suction pump and dirt/water receptacle, which is an expensive, clumsy, and inflexible arrangement.

SUMMARY OF THE INVENTION

There are now widely available so-called "wet-and-dry" vacuum cleaning devices which are capable of removing by suction not only dirt particles but also wet or liquid waste material. It is an object of this invention to provide attachments for use with such vacuum cleaning devices, to produce efficient and flexible carpet cleaning apparatus, at a cost which is modest compared to the dedicated carpet cleaning apparatus as described above.

Accordingly, the present invention comprises a carpet cleaning attachment, for use with existing carpet cleaning devices having a flexible attachment hose and a unit capable of extracting both wet and dry materials, the attachment comprising means defining a hollow, elongated, hand-held wand configured at a connection end thereof for connection to the hose and provided at the opposite end with a suction nozzle for being moved across a carpet; cleaning fluid reservoir means mounted on the wand; and cleaning fluid delivery means carried on the wand for delivering cleaning fluid from the reservoir to a region of the carpet in advance of the moving nozzle.

Advantageously, the wand is provided with ground engaging means for controlling the attitude of the wand relative to the carpet surface.

Suitably, the ground engaging means comprises roller means displaceable relative to the wand into a transport position and an operating position.

Advantageously, the cleaning fluid delivery system includes an electrically operated fluid pump for spraying fluid onto the carpet.

In another form of the invention, the cleaning fluid system includes a manually operable pump for creating a charge of compressed air above cleaning fluid contained in the reservoir.

It will be understood that the carpet cleaning attachments in accordance with this invention can be arranged for direct coupling to the suction hose of one or more commercially available wet and dry vacuum cleaning units. The cost of the attachments should be considerably less than that of previously known dedicated carpet cleaning apparatus and the wet and dry vacuum unit can be used for a variety of other purposes when not employed with the attachment.

BRIEF DESCRIPTION OF THE DRAWINGS

Other objects, features and advantages of the invention will be understood from the following description of embodiments thereof, with reference to the accompanying drawings, in which.

DETAILED DESCRIPTION OF THE DISCLOSED EMBODIMENTS

Figure 1:
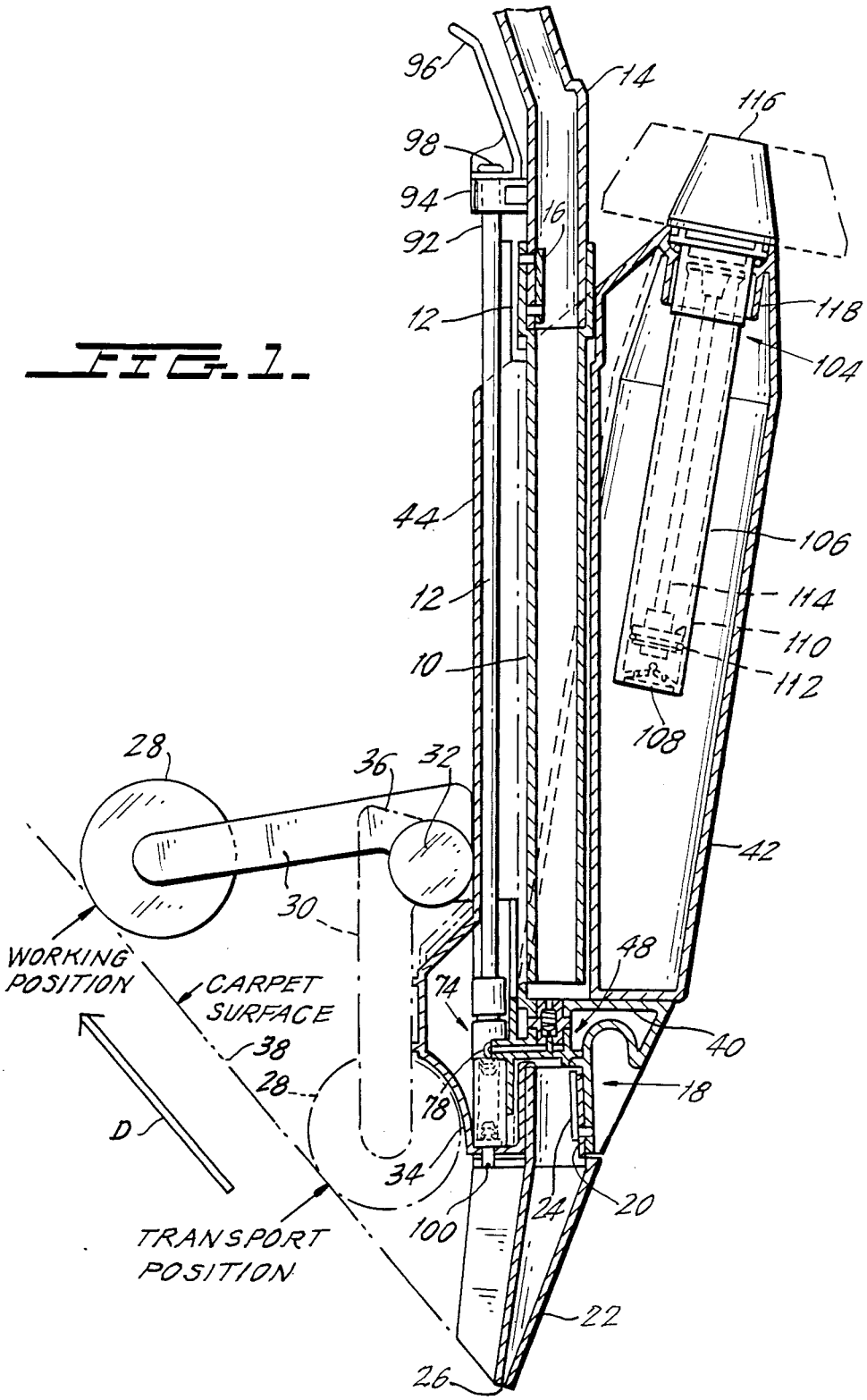
FIG. 1 is an end view, partly in section, of a carpet cleaning attachment according to this invention.

Referring first to FIG. 1, there is shown a carpet cleaning attachment according to one embodiment of this invention which is intended to be used with any one of a variety of commercially available wet and dry vacuum cleaners.

Figure 2:
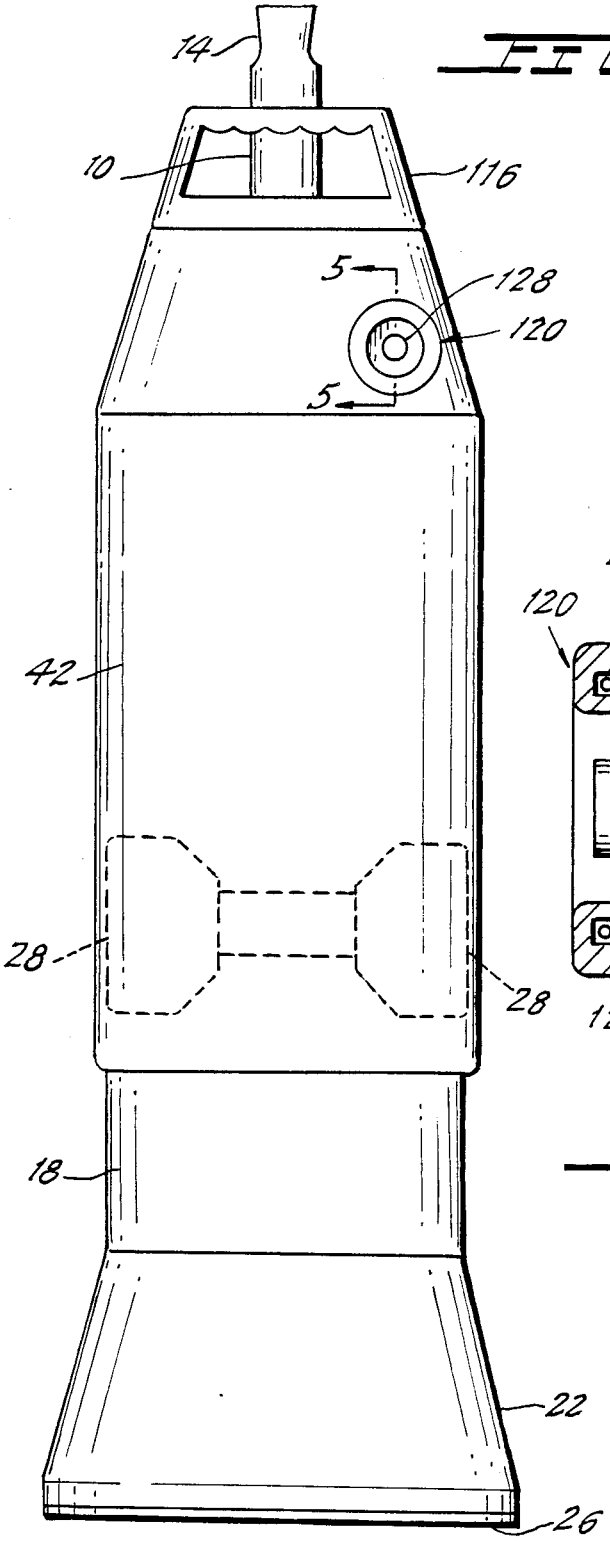
FIG. 2 is a front view of the attachment shown in FIG. 1.

A generally tubular wand 10 is formed at its upper end with a stepped portion 12 which receives a hose connector 14 held in place by spring clip 16. The connector 14 is engageable as a push-fit with the suction hose (not shown) of the vacuum cleaner. Towards the lower end of the wand 10, there is formed an integral support portion 18. This portion defines a downwardly directed recess 20 in which is received the stub of a suction nozzle 22. The nozzle is held in place by means of a further spring clip 24. As best seen in FIG. 2, the nozzle 22 is fan-shaped and defines a relatively narrow transverse nozzle opening 26.

As seen in FIGS. 1 and 2, a pair of rollers 28 are mounted coaxially on a roller arm 30. The arm 30 is pivotally mounted upon axle 32 for movement relative to the support portion 18 from a transport position in which the rollers 28 are partly received within a curved recess 34 of the support portion, to a working position in which the arm 30 is held at approximately 90° to the length of the wand through engagement of an abutment surface 36 on the arm with the support portion 18. With the roller arm 30 in the working position, and both the suction nozzle opening 26 and rollers 28 in contact with the carpet surface, the attachment is held at the optimum working angle of approximately 45°, for being moved across the carpet in the direction labeled D in FIG. 1. The level of the carpet surface is shown in FIG. 1 at 38, by way of illustration.

The support portion 18 defines a projecting platform 40 upon which rests a clean water reservoir 42. The reservoir extends over most of the length of the wand and has side wings 44 which partially encircle the wand. At the bottom of the reservoir 42, there is formed an aperture 46 into which is sealed a check valve unit 48.

Figure 3:
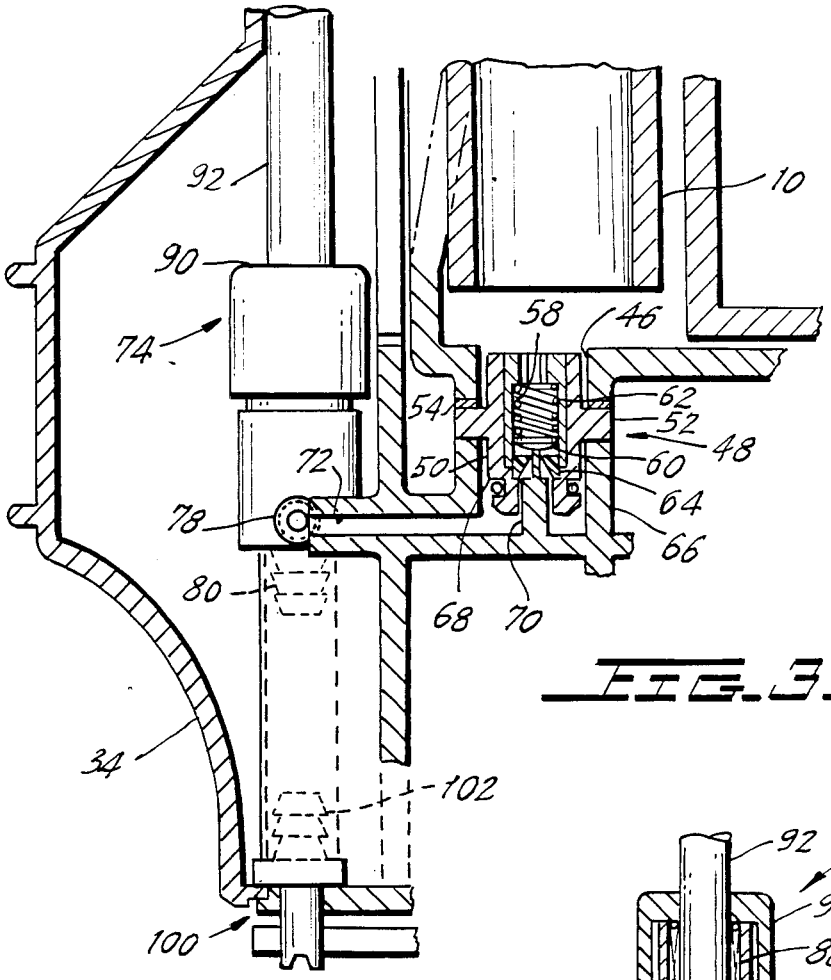
FIG. 3 is a detail view, on a larger scale, of part of the attachment shown in FIG. 1.

As seen more clearly in FIG. 3, the check valve unit 48 comprises a cylindrical body 50 with an annular flange 52 which abuts the lower edge of the reservoir through seal 54. A sleeve 56 contained within the body has a central bore 58 accommodating a valve member 60 urged through compression spring 62 into engagement with valve seat 64. The body 50 is received within a port 66 of the support portion 18 with a water tight seal being assured by means of an O-ring carried in an annular recess 68 of the body. Coaxially with the port 66, the support portion 18 is provided with an upstanding peg 70.

With the reservoir 42 positioned on the support portion 18 as shown in the Figures, engagement of the peg 70 with the valve member 60 compresses the spring 62 and allows water from the reservoir 42 to pass through the valve, into the port 66 of the support portion. Then the water passes along a bore 72 formed in the support portion 18 which runs from the vicinity of the peg 70. If the reservoir is removed for refilling, the spring 62 acts to close the valve to prevent leakage.

Figure 4:
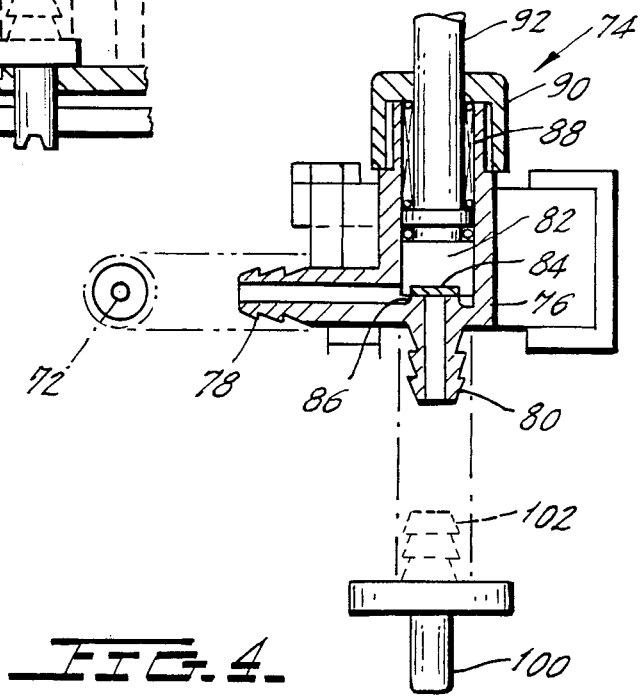
FIG. 4 is a detail view, on a larger scale, of another part of the attachment shown in FIG. 1.

Referring now to FIG. 4, a control valve 74 is mounted in the support portion 18 and comprises a cylindrical body 76 defining inlet and outlet ports 78 and 80, respectively. Inlet port 78 is connected through tubing with the bore 72 of the support portion. The body 76 accommodates a piston 82 having a washer 84 abutting (in the position shown in the Figure) a valve seat 86 formed around the outlet port 80. The piston is slidable upwardly from the position shown in FIG. 4 against the action of a compression spring 88 trapped between the piston 82 and an end cap 90. An elongated piston rod 92 extends through the cap 90 along the entire length of the wand 10.

As seen in FIG. 1, the piston rod 92 passes through a bracket 94 on the hose connector 14 and through an aperture in a control lever 96. The piston rod terminates in an enlarged head 98 and the control lever 96 is shaped so that finger pressure on the lever, tending to move it towards the hose connector 14, lifts the rod head 98 away from the bracket 94. It will be seen in FIG. 4 that as the piston rod 92 is lifted, washer 84 is moved away from valve seat 86, permitting water to flow from the inlet port 78 to the outlet port 80.

In the support portion 18, directly beneath the control valve 74, there is mounted a spray element 100 having a spigot 102 connected through tubing to the outlet port 80 of the control valve. The spray element 100 is adapted to provide a fan-shaped spray of water extending over generally the same transverse width as the nozzle opening 26.

As shown in FIG. 1, the reservoir 42 is provided at its upper end with a manually operated pump assembly 104. This pump assembly comprises a cylinder 106 extending into the reservoir and closed at its lower end by a one-way flap valve 108. A piston 110 is slidably mounted in the cylinder 106 and sealed with an O-ring 112. A piston rod 114 extends from the piston 110 to a shaped handle 116 seated on the upper surface of the reservoir. The pump assembly 104 is located within the reservoir by means of an integral collar 118. A locking mechanism is desirably included, by which rotation of the handle 116 through 90° releases the piston assembly for reciprocal motion.

Figure 5:
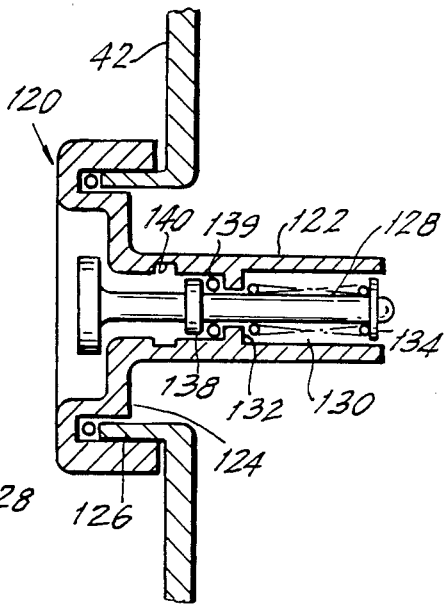
FIG. 5 is an enlarged sectional view taken on line 5—5 of FIG. 2.

As seen in FIGS. 2 and 5, the reservoir is provided with a cap 120 which may be removed for refilling the reservoir. The cap comprises a cylindrical body 122 formed integrally with a dished portion 124 which engages an upturned flange 126 on the reservoir 42. A plunger 128 extends through the body portion 122 and is biased towards the position shown in FIG. 5 by means of compression spring 130 acting between a central wall 132 of the body portion and a disc 134 carried on the inner end of the plunger. A disc 138 formed integrally with the plunger provides a location for an O-ring 139 which is in sealing engagement with the inner cylindrical surface of the body 122. As the pressure in the reservoir increases on pumping of the pump assembly 104, the plunger moves outward, providing a visual indication of the increase in pressure. At a predetermined pressure (40 psi in the described example) the plunger has travelled a sufficient distance for the O-ring 139 to move into a rebate 140, allowing excess air pressure to be vented.

The manner of operation of the described apparatus can now be understood.

The reservoir 42 is partly filled with water including, if desired, a suitable detergent or other additive. The handle 116 is freed from the reservoir and reciprocated in a pumping action to establish a charge of compressed air above the water contained within the reservoir. It will be understood that in this pumping action, flap valve 108 operates as a one-way valve. When a sufficient pressure has been reached, the handle 116 is relocked in position. With the suction hose of a wet-and-dry vacuum cleaner engaged with hose connector 14, the attachment is then moved slowly over the carpet to be cleaned. The rollers 28 assist the user in ensuring that the wand is held at the optimum angle to the carpet surface for efficient extraction by suction nozzle 26. Finger pressure on lever 96 serves, as described, to open control valve 74 so that water from the reservoir is delivered under pressure to spray element 100, and thus to the region of the carpet immediately in advance of the moving suction nozzle opening 26, as the attachment is moved in the direction D (FIG. 1).

The described carpet cleaning attachment makes use of the vacuum unit, suction hose and dirt/water receptacle of the existing wet-and-dry vacuum cleaner. The attachment is therefore relatively light and easily maneuverable. Moreover, the attachment is relatively inexpensive to manufacture. Because the delivery system for water or other cleaning fluid is positioned on the wand and thus very close to the point of delivery, it is possible to achieve high pressures, so the water spray can penetrate the pile of the carpet. This is in contrast with certain known apparatus, where the necessity for a long tube extending the length of the suction hose leads to very low delivery pressures.

Figure 6:
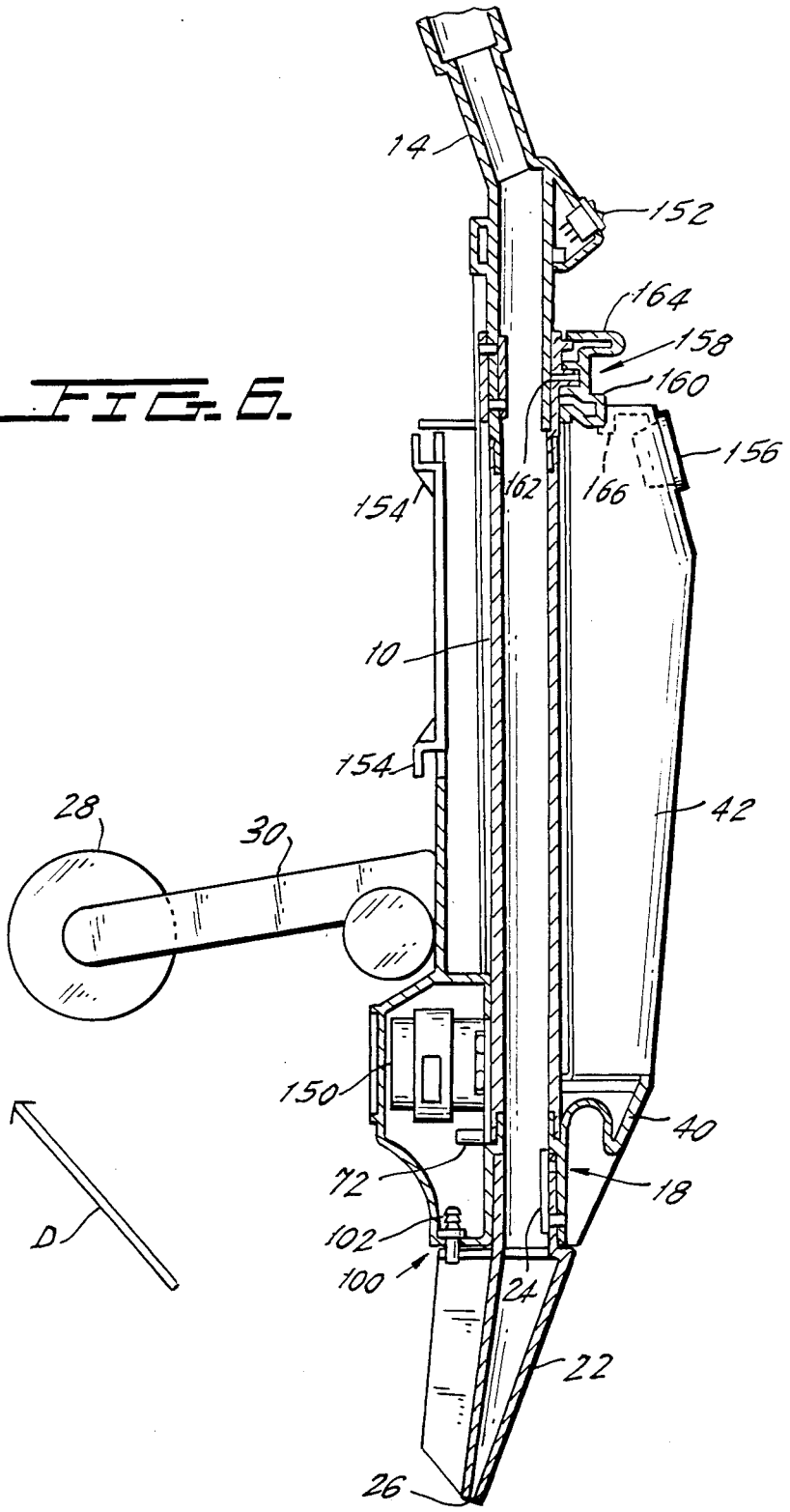
FIG. 6 is an end view, partly in section, of a further carpet cleaning attachment according to this invention.

In a further embodiment of this invention, shown in FIG. 6, the above-described manually operated pump is replaced by an electrically powered pump.

Referring now to FIG. 6, there is shown a modified carpet cleaning attachment according to this invention. Parts and features which correspond to the embodiment of FIGS. 1 to 5 have been given the same reference numerals and will not be described in detail.

An electrically operated water pump 150 is mounted in the support portion 18 and is supplied with electrical power via a toggle switch 152 mounted in the hose connector 14. The attachment is provided with a supply lead (not shown) which is adapted for being connected with a socket for powered accessories provided on the existing vacuum cleaner. A cable winder 154 is provided on the accessory for easy storage of the supply cable.

The pump 150 has an inlet (not shown) connected through flexible tubing with the bore 72, and an outlet (also not shown) connected through flexible tubing with the spray element 100.

The reservoir 42 is of smaller size than in the manually operated embodiment, since there is no longer any need to accommodate a charge of compressible air above the contained water. For similar reasons, a simple push-fit filler cap 156 can be employed. As in the previous embodiment, the reservoir is arranged to be removable for refilling, and a locking mechanism 158 for holding the reservoir in position is shown in the drawing. The locking mechanism comprises a cam 160, which is rotatable relative to the wand, about axle 162, through finger engagement with a peg 164. The cam engages a cam surface 166 formed on the reservoir so that, upon rotation of the cam, the reservoir is drawn tightly into position and thereby held against being dislodged.

The modified carpet attachment is used in a manner analogous to that described above, with the delivery of water being controlled through switch 152.

It should be understood that this invention has been described by way of examples only, and a great variety of modifications are possible without departing from the scope of the invention. For example, other systems than those specifically described could be employed for delivering water to the carpet surface in advance of the suction nozzle. In place of the manual system for pressurizing the air in the reservoir above the clean water, a cylinder of compressed air could be provided. The reservoir could take a variety of forms and need not necessarily be removable. If the reservoir is to be removable, it is desirable, although not essential, to have a non-return valve to prevent leakage. It will be apparent to a person of ordinary skill in the art that a variety of latch mechanisms could be employed for holding the reservoir in position on the wand. The use of rollers, or alternative ground engaging means such as a skid, to assist in controlling the attitude of the wand relative to the carpet surface is thought to be a desirable feature but should not be regarded as essential. It is preferred, therefore, that the present invention be limited not by the specific disclosure herein, but only by the appended claims.

What is claimed is:

1. A carpet cleaning attachment, for use with existing carpet cleaning devices having a flexible attachment hose and a unit capable of extracting both wet and dry materials, the attachment comprising hollow, elongated, hand-held wand means configured at a connection end thereof for connection to the hose and provided at the opposite end with suction nozzle means communicating with said connection end for being moved across a carpet to clean said carpet;

cleaning fluid reservoir means mounted on the wand means and having a cap;

means for creating a pressurized condition in said reservoir means;

detecting means for said reservoir means on said cap for detecting said pressurized condition and indicating the pressure thereof; and cleaning fluid delivery means carried on the wand means for delivering cleaning fluid from the reservoir means to a region of the carpet in advance of the moving nozzle means to assist in said cleaning of said carpet.

2. A carpet cleaning attachment as in claim 1, further comprising ground engaging means carried on the wand for controlling the attitude of the wand relative to the carpet surface.

3. A carpet cleaning attachment as in claim 2, wherein said ground engaging means comprises roller means displaceable with respect to the wand into a transport position and an operating position.

4. A carpet cleaning attachment as in claim 3, wherein said region of the carpet to which said cleaning fluid is delivered is between the suction nozzle and the roller means when said roller means is in said operating position.

5. A carpet cleaning attachment as in claim 1, where said cleaning fluid delivery means comprises electrically operated pump means for receiving and pumping fluid from the reservoir means, and means for spraying said pumped fluid onto said region of the carpet.

6. A carpet cleaning attachment as in claim 1, wherein said means for creating a pressurized condition in said reservoir means is manually operated and creates a charge of compressed air in the reservoir means, and said cleaning fluid delivery means comprises means for spraying said fluid onto said region of the carpet under pressure of said charge of compressed air.

7. A carpet cleaning attachment as in claim 6, wherein said detecting means for said reservoir means detects said charge of compressed air and is outwardly projected from said reservoir means for indicating the pressure of said charge.

8. A carpet cleaning attachment as in claim 7, wherein said detecting means further comprises vent means for venting said charge from said reservoir means when said charge pressure reaches a predetermined value.

9. A carpet cleaning attachment as in claim 1, wherein said roller means is flush against said wand means, between said suction nozzle and said connection end, when said roller means is in said transport position.

10. In combination, extracting means comprising a flexible attachment hose which communicates with a unit capable of extracting both wet and dry materials from a carpet through said flexible attachment hose; and a carpet cleaning attachment, the attachment comprising hollow, elongated, hand-held wand means connected at a connection end thereof to the attachment hose of the extracting means, and provided at the opposite end with suction nozzle means communicating with said connection end for being moved across a carpet to clean said carpet;

cleaning fluid reservoir means mounted on the wand means and having a cap;

means for creating a pressurized condition in said reservoir means;

detecting means for said reservoir means on said cap for detecting said pressurized condition and indicating the pressure thereof; and cleaning fluid delivery means carried on the wand means for delivering cleaning fluid from the reservoir means to a region of the carpet in advance of the moving nozzle means to assist in said cleaning of said carpet.

11. A combination as in claim 10, wherein said cleaning fluid delivery means comprises electrically operated pump means for receiving and pumping fluid from the reservoir means, and means for spraying said pumped fluid onto said region of the carpet.

12. A combination as in claim 10, wherein said means for creating a pressurized condition in said reservoir means is manually operated and creates a charge of compressed air in the reservoir means, and said cleaning fluid delivery means comprises means for spraying said fluid onto said region of the carpet under pressure of said charge of compressed air.

13. A combination as in claim 12, wherein said detecting means on said reservoir means detects said charge of compressed air and is outwardly projected from said reservoir means for indicating the pressure of said charge.

14. A combination as in claim 13, wherein said detecting means further comprises vent means for venting said charge from said reservoir means when said charge pressure reaches a predetermined value.

15. A carpet cleaning attachment as in claim 1, wherein said cap is removable from said reservoir means, thereby permitting said reservoir means to be filled with cleaning fluid.

16. A combination as in claim 10, wherein said cap is removable from said reservoir means, thereby permitting said reservoir means to be filled with cleaning fluid.

* * * * *